US005293659A

United States Patent [19]

Rief et al.

[11] Patent Number: 5,293,659

[45] Date of Patent: Mar. 15, 1994

[54] AUTOMATIC SWIMMING POOL CLEANER

[76] Inventors: Dieter J. Rief, 8016 Mitchell Dr., Rohnert Park, Calif. 94928; Herman E. Frentzel, 424 Bee Stree, Sausalito, Calif. 94965; Jerauld G. Wright, 56, The Sparks Street Mall, Suite 100, Ottawa, Ont. K1P 5A9, Canada; Paul Sebor, 45 Highcliff Way, Northcliff Ext. 12, Johannesburg 2195, South Africa

[21] Appl. No.: 52,699

[22] Filed: Apr. 27, 1993

Related U.S. Application Data

[63] Continuation of Ser. No. 771,787, Oct. 4, 1991, abandoned, which is a continuation of Ser. No. 758,005, Sep. 12, 1991, abandoned, Continuation-in-part of Ser. No. 586,425, Sep. 21, 1990, abandoned.

[51] Int. Cl.[5] ..... E04H 3/20

[52] U.S. Cl. ..... 15/1.7

[58] Field of Search ..... 15/1.7

[56] References Cited

U.S. PATENT DOCUMENTS

| | | | |
|---|---|---|---|
| 3,803,658 | 4/1974 | Raubenheimer | 15/1.7 |
| 4,023,227 | 5/1977 | Chauvier | 15/1.7 |
| 4,275,474 | 6/1981 | Woodard | 15/1.7 |
| 4,536,908 | 8/1985 | Raubenheimer | 15/1.7 |

*Primary Examiner*—Edward L. Roberts

*Attorney, Agent, or Firm*—Jansson & Shupe, Ltd.

[57] ABSTRACT

A suction head for a swimming pool cleaner comprising a housing which is open at its lower side and has inclined bristles attached to its lower edge for supporting on a surface to be cleaned. The housing has a rotary sleeve mounted to its top for connection of a suction hose in turn to be connected to a water suction pump. Said sleeve opens in a chamber within the housing in which a vibratory element is pivotally mounted, said element having a crescent or air-foil shape. By a flow of water sucked through said chamber, the vibratory element is automatically brought into a vibrating movement which imparts pulsations on the suction head. Thereby, the inclined bristles are bent and straightened repetitively, resulting in a forward thrust moving the suction head over the surface to be cleaned. At least one foot is disposed in the housing which is cyclically displaced vertically by a driving mechanism driven by the movement of the vibratory element and returned by return springs. Said foot cyclically lifts off the suction head at one side, resulting in a rotational movement of the suction head about a vertical axis so as to change the direction of forward movement of the suction head.

37 Claims, 11 Drawing Sheets

AUTOMATIC SWIMMING POOL CLEANER

RELATED APPLICATION

This application is a continuation of Ser. No. 07/771,787 filed Oct. 4, 1991, (not abandoned), which is a continuation of Ser. No. 07/758,005 filed Sep. 12, 991 (now abandoned), which is a continuation-in-part of Ser. No. 07/586,425 filed Sep. 21, 1990 (now abandoned).

The invention relates to an automatic swimming pool cleaner and, in particular, to a suction head of a swimming pool cleaner, to be used in a water-filled swimming pool and which is adapted to be connected to a suction pump which causes a flow of water through the suction head.

A suction head for a swimming pool cleaner system is known from U.S. Pat. No. 4 275 474 (Woodard) which comprises a housing open at its lower side and to whose upper side a connecting sleeve is mounted for connecting a suction hose in turn connected to a suction pump. Brush bristles extend vertically downwardly from the lower edge of the housing. A pole is furthermore attached to the upper side of the suction head which is intended for handling the suction head. This suction head can be handled like an ordinary broom or a vacuum cleaner nozzle. It is not capable of moving automatically across the bottom of the swimming pool to be cleaned, but must be manually guided by means of the pole.

A cleaning device for a water-filled swimming pool is known from U.S. Pat. No. 4 351 077 which consists of a disc of flexible plastic material and a housing attached at its upper side in the center of and obliquely inclined against the disc, a connecting sleeve for connection of the end of a suction hose being mounted to the upper end of said housing. A flap valve pivotally mounted in the housing creates a pulsating motion when a water flow caused by a suction pump connected to the other end of said suction hose passes through said housing, said pulsating motion causing the cleaning device to move about the bottom and wall surfaces of the swimming pool in a random fashion.

The object of the invention is a suction head which moves automatically in a random fashion through a swimming pool when a suction flow of water is caused to pass through said suction head.

An additional object of the invention is to provide a suction head which can change its direction of movement automatically.

A further object of the invention is to provide a suction head which reliably cleans a swimming pool bottom and side walls.

A still further object of the invention is to provide a suction head which can easily and rapidly disassembled for cleaning and maintenance purposes and re-assembled without the aid of complex tools.

These and further objects of the present invention are accomplished by a suction head for a swimming pool cleaner comprising a housing open at its lower side and comprising there a lower edge to which flexible brush bristles are affixed and which has a connecting sleeve at its upper side adapted for rotatably connecting one end of a suction hose to the housing, said connecting sleeve opening into a downwardly open chamber formed in the housing, in which chamber a vibratory element is pivotally mounted in a swivelling axis and automatically vibrates back and forth when a flow of water is drawn past it through said chamber by the effect of a suction pump connected to the other end of said suction hose. The resulting vibrations of the vibratory element cause the entire suction head to vibrate, including the flexible bristles which project downwardly from the housing and whose free ends end in a common plane and which are inclined in a specific common direction so that they enclose an angle deviating from the vertical onto the plane defined by their free ends.

During operation the vibratory movement of the suction head is imparted to the obliquely disposed bristles which bend and straighten repetitively, so that the bristles produce a pushing force acting on the suction head moving it across the surface engaged by the bristles and to be cleaned. At the same time, the bristles also lift off dirt from the surface to be cleaned, said dirt being sucked through the suction head and away through the suction hose into a filter by the effect of the water flow sucked through the housing.

According to a preferred embodiment of the invention, at least one foot is displaceably mounted eccentrically in the housing, said foot being movable vertically with respect to the plane defined by the free ends of the bristles. A foot driving mechanism is located in the housing and is driven by the suction flow passing through the housing by means of the vibratory element, said foot driving mechanism acting on the at least one foot in a manner that its lower end can be advanced downwardly beyond the plane defined by the free ends of the bristles and can be upwardly returned. In this manner the suction head is temporarily lifted off from the surface to be cleaned one-sidedly by said at least one foot during operation. Where two feet are mounted in the housing, they are disposed on either side of the center of said suction head and are operated in an alternating manner so that the suction head is temporarily partially lifted off from the surface to be cleaned in an alternating manner on either side.

The result of this partially lifting off the suction head is that the suction head is rotated about an axis extending vertically to the surface to be cleaned. This effect is brought about by said foot lifting off in increasing number of bristles from the surface to be cleaned so that they become inactive, whereas the bristles still in contact with the surface to be cleaned push the suction head one-sidedly. Thus, a change of orientation of the suction head results therefrom so that after the return of the foot in its retracted or upper position the suction head will again move off straighly, but in a different direction.

In the preferred embodiment, the at least one foot is formed by a brush support to whose lower side brush bristles are attached which are inclined in opposite fashion to the inclination of the bristles attached to the lower edge of the housing. The bristles on the brush support also perform a bending and straightening movement under the effect of thre load force of the suction head when downwardly displaced and, thus, brought into contact with the surface to be cleaned. In this downwardly displaced position, under the vibrating movement of the suction head the bristles of the support do not brake, but even cause a thrust which is opposite to the thrust of the bristles attached to the lower edge of the suction head housing. Thus, the combined thrusts of the bristles result in a rotational movement of the suction head about an axis which is vertical to the surface to be cleaned.

The driving mechanism for the at least one foot is driven by the vibratory element and comprises transfer means which transfer the pivotal, back and forth going movement of the vibratory element into a unidirectional rotational movement and rotating cam means engaging said at least one foot and driven by said transfer means.

A special advantage of the invention is that the suction head is operative with a flow of water passing through the suction head which is relatively weak as compared with the prior art and, nevertheless, achieves a good cleaning effect, since the movement of the bristles effects the lifting off of dirt from the surface to be cleaned. It must furthermore be noted that the suction head can also be used for cleaning the walls of a swimming pool. A further important advantage of the invention is that the flow of water is substantially continuous and uniform and does not pulsate, which makes for a less noisy operation.

Further features of the invention, their advantages and their effects are explained in more detail in the following with reference to the accompanying drawings, in which:

FIG. 1 shows a perspective view of the suction head according to the invention and an exploded view of details thereof contained in its housing;

FIG. 1*a* shows a perspective view of a suction head similar to FIG. 1 but having two displaceable feet;

Figure 1:
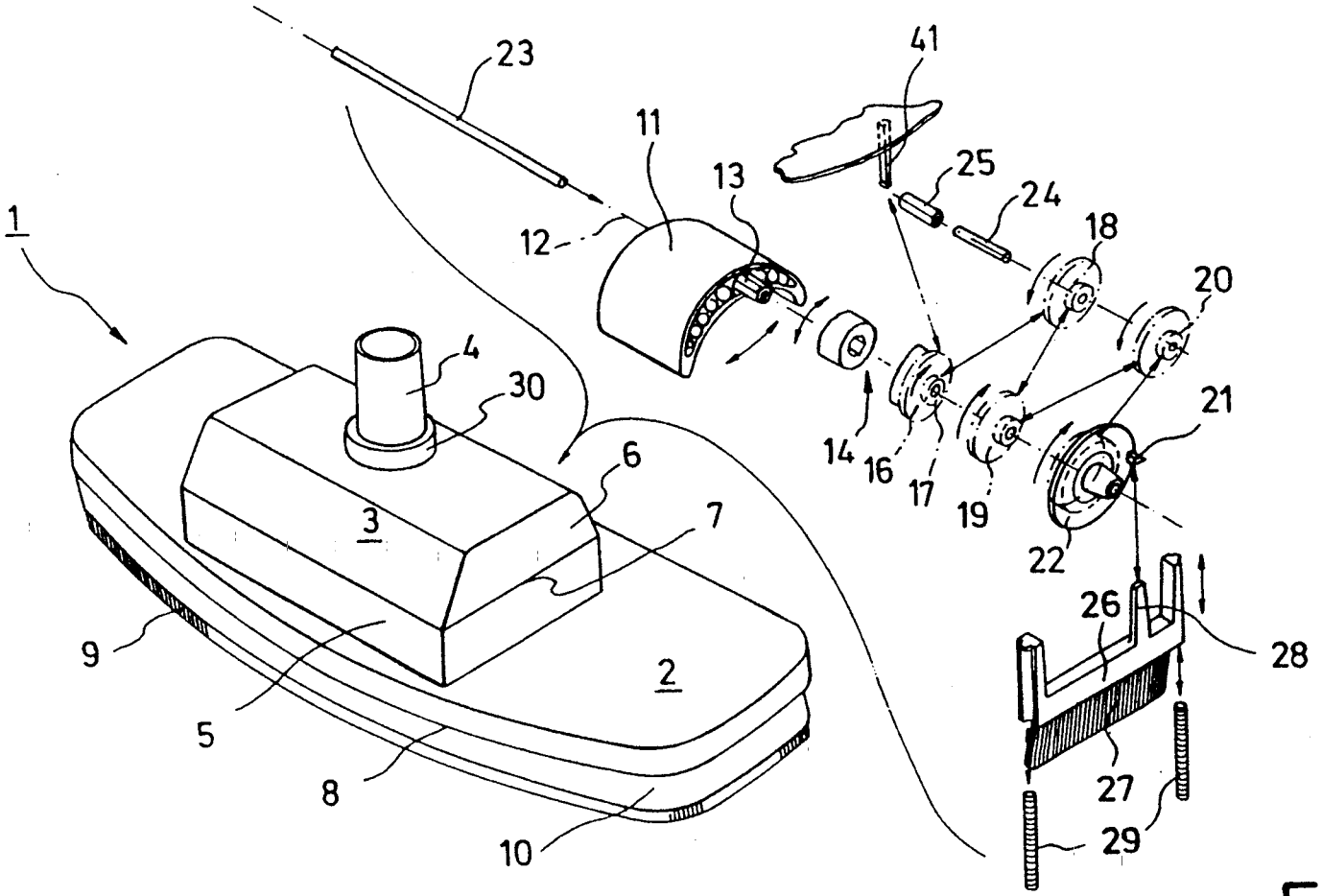
Figure 1A:
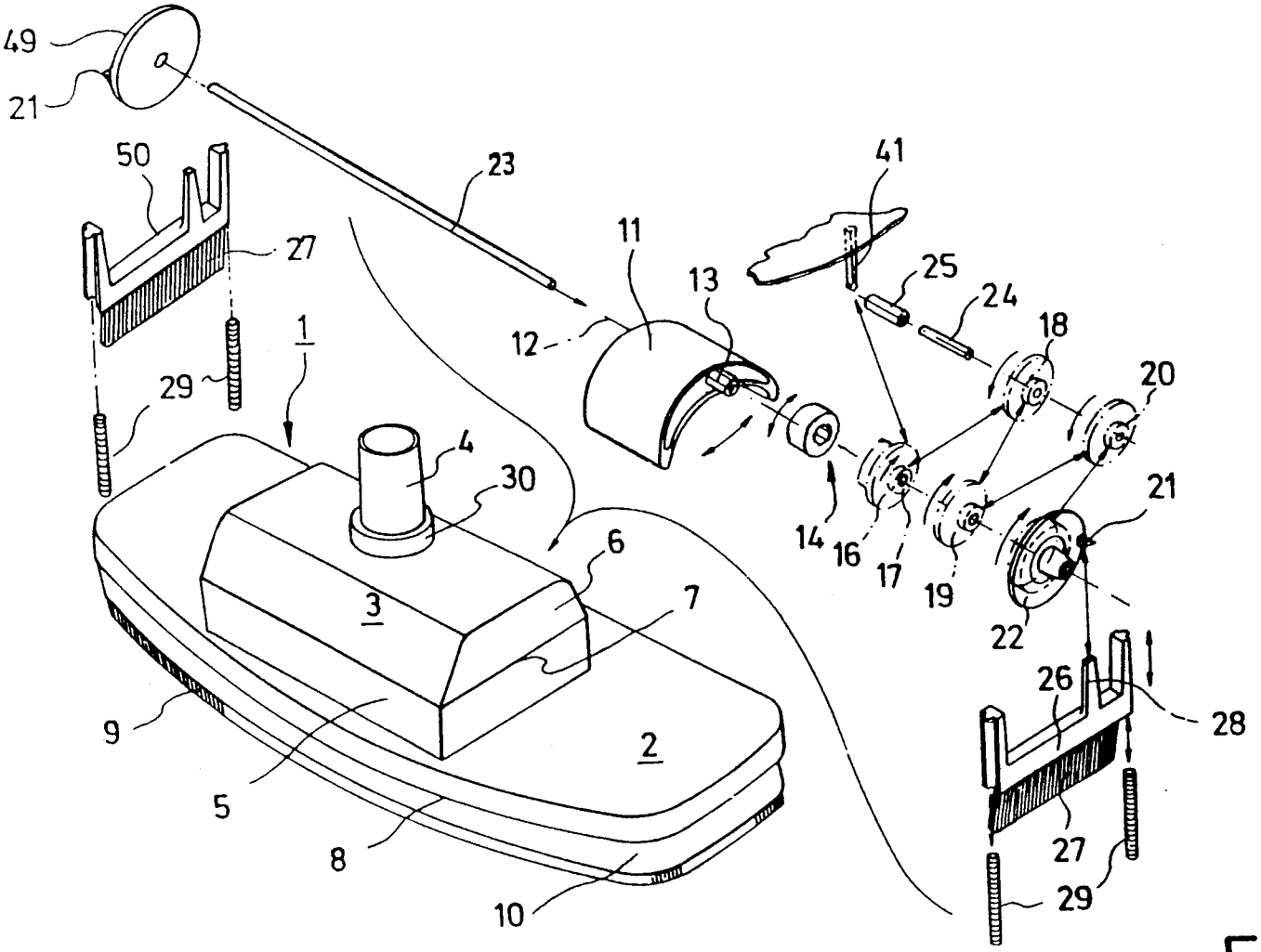
Figure 2:
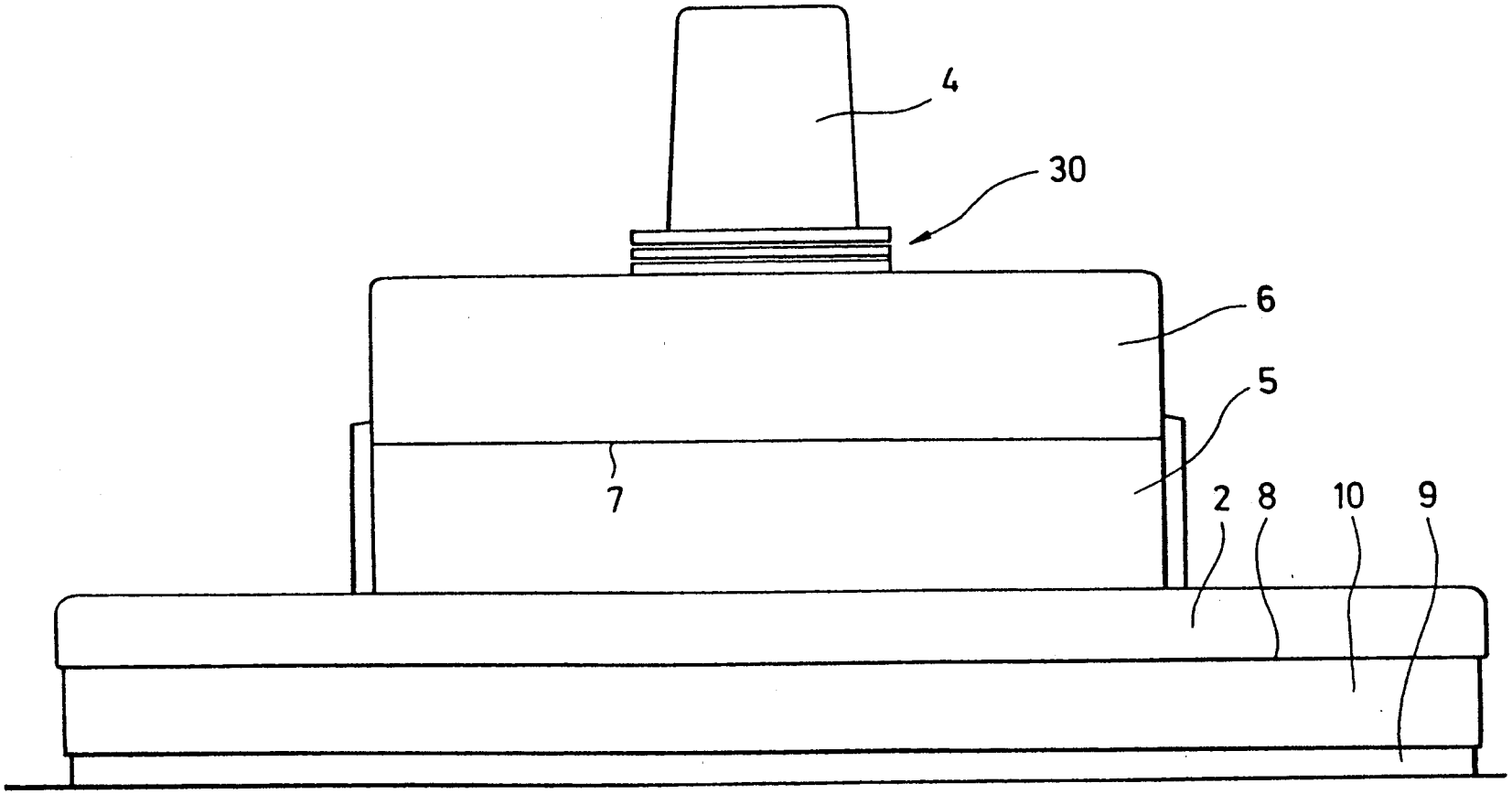
FIG. 2 shows a rear view of the suction head of FIG. 1.
Figure 5:
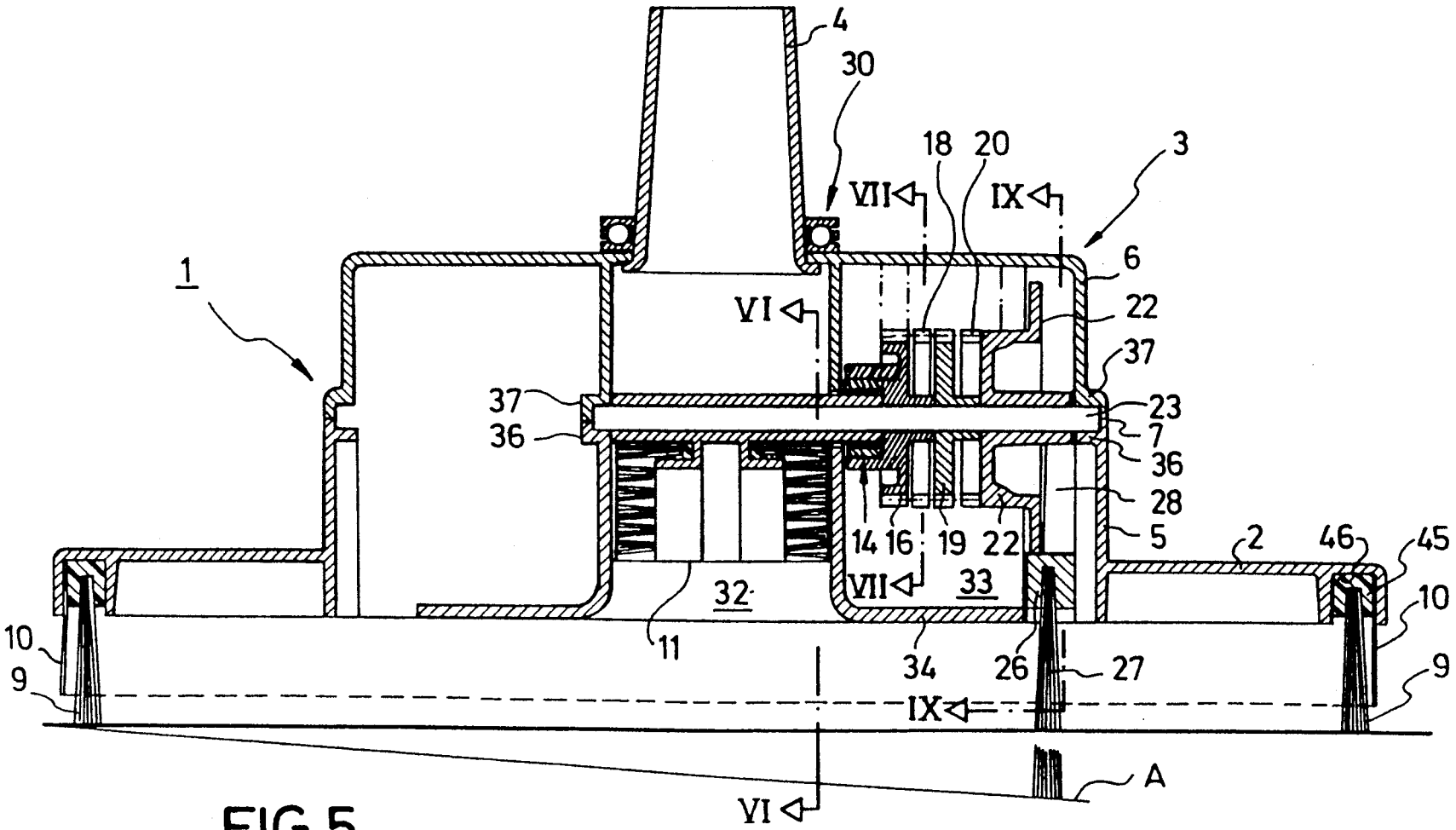
FIG. 5 shows a front view of the suction head of FIG. 1 as a vertical section along line V—V of FIG. 3.
Figure 5A:
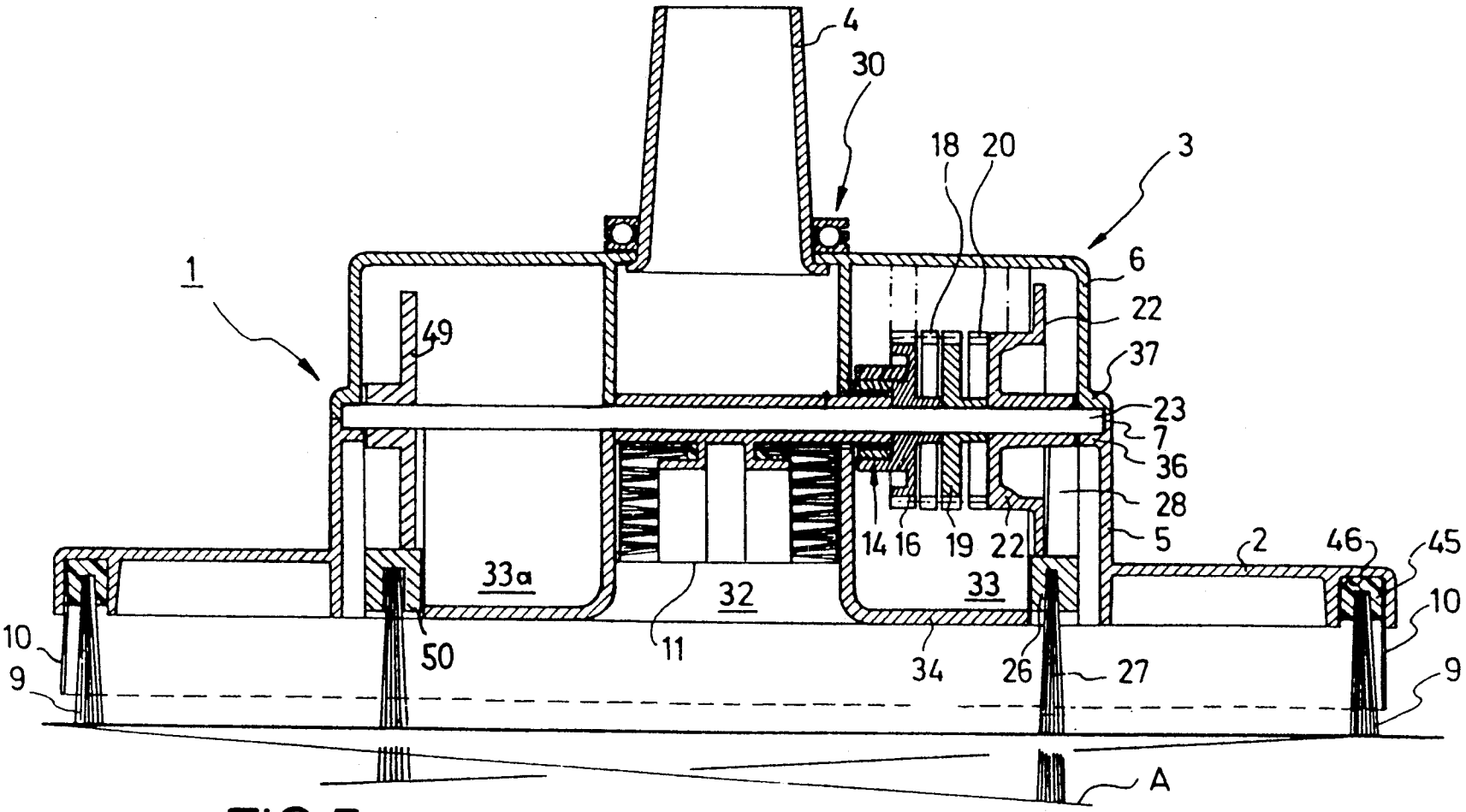
Figure 6:
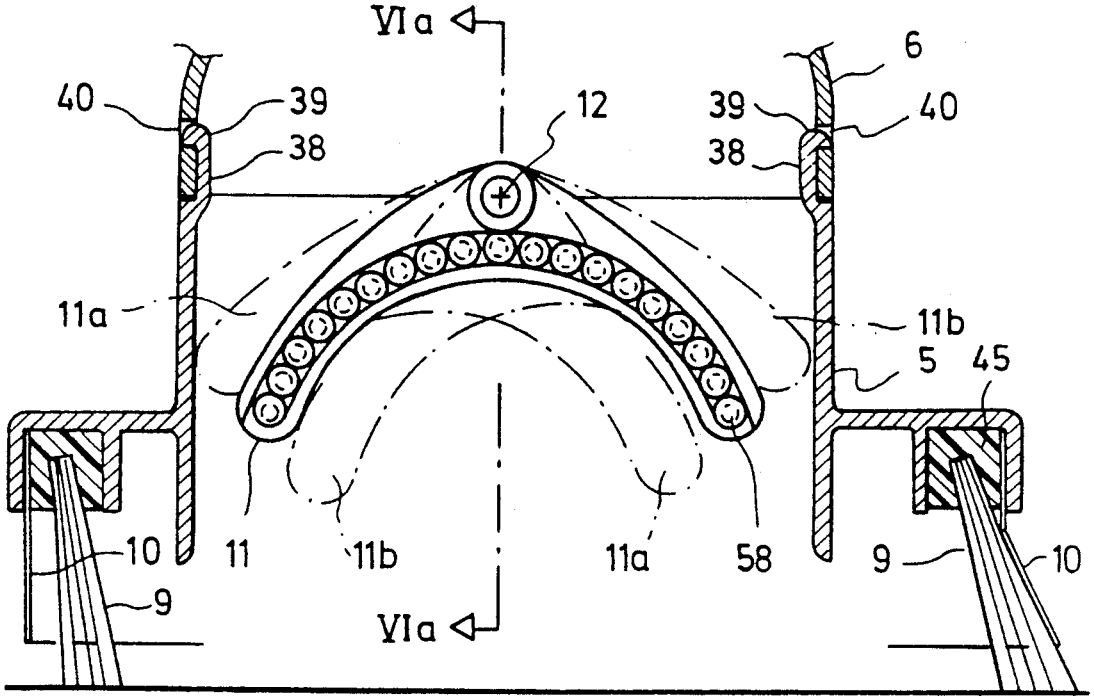
Figure 6A:
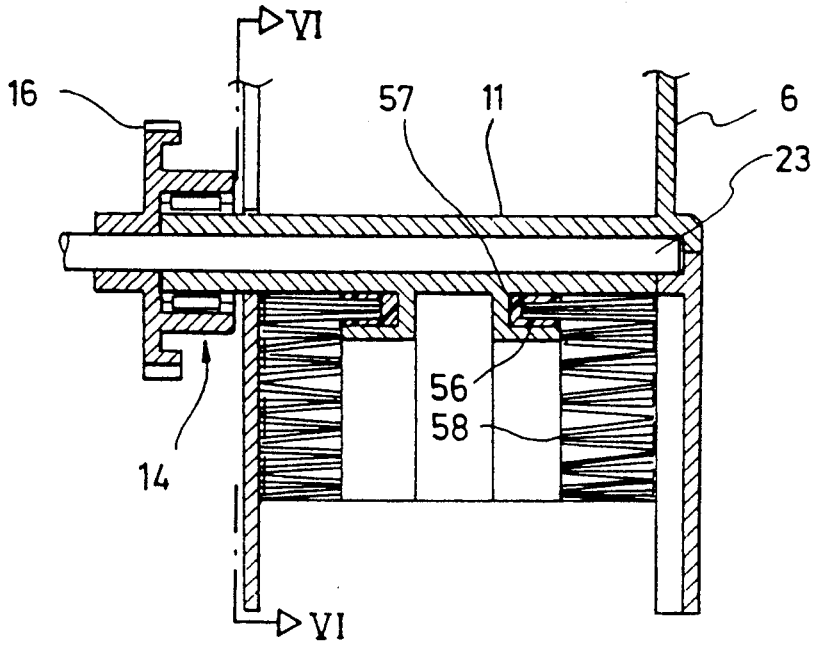
Figure 7:
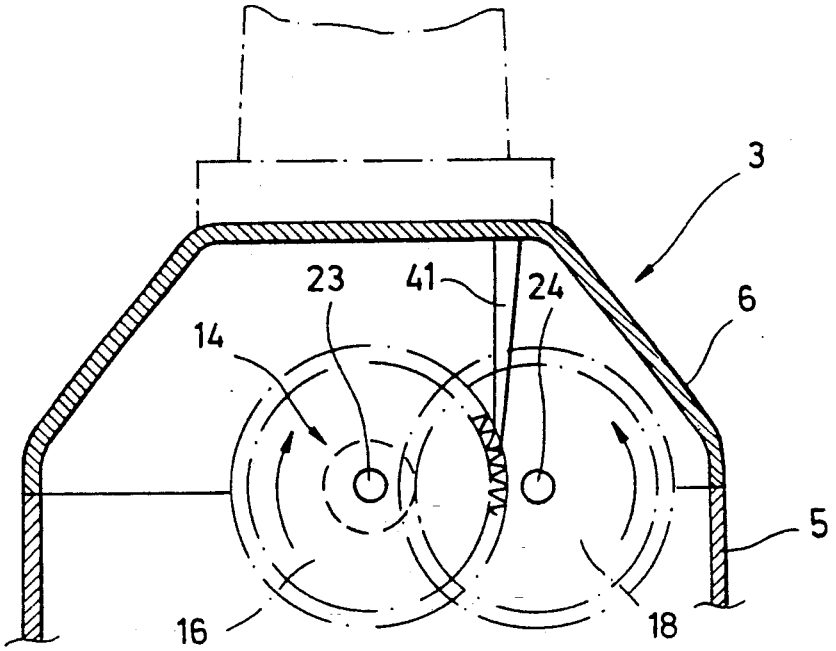
Figure 8:
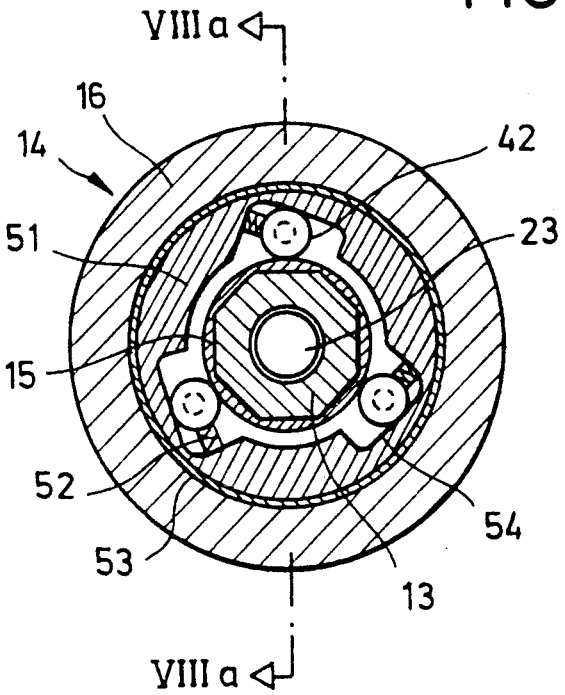
Figure 8A:
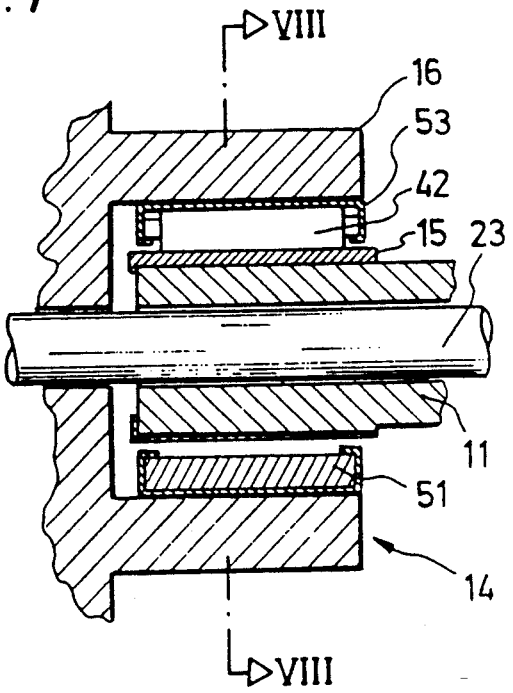

FIG. 5*a* shows a front view of the suction head of FIG. 1*a* as a vertical section similar to FIG. 5;

FIG. 6 shows a lateral view through part of the suction head as a vertical view along the line VI—VI of FIG. 5;

FIG. 6*a* shows a cross-sectional view of FIG. 6 along the line VIa—VIa of FIG. 6;

FIG. 7 shows details of the section through FIG. 5 along the line VII—VII of FIG. 5;

FIG. 8 shows a cross-sectional view of the one-way clutch along line VIII—VIII of FIG. 8*a;*

Figure 9:
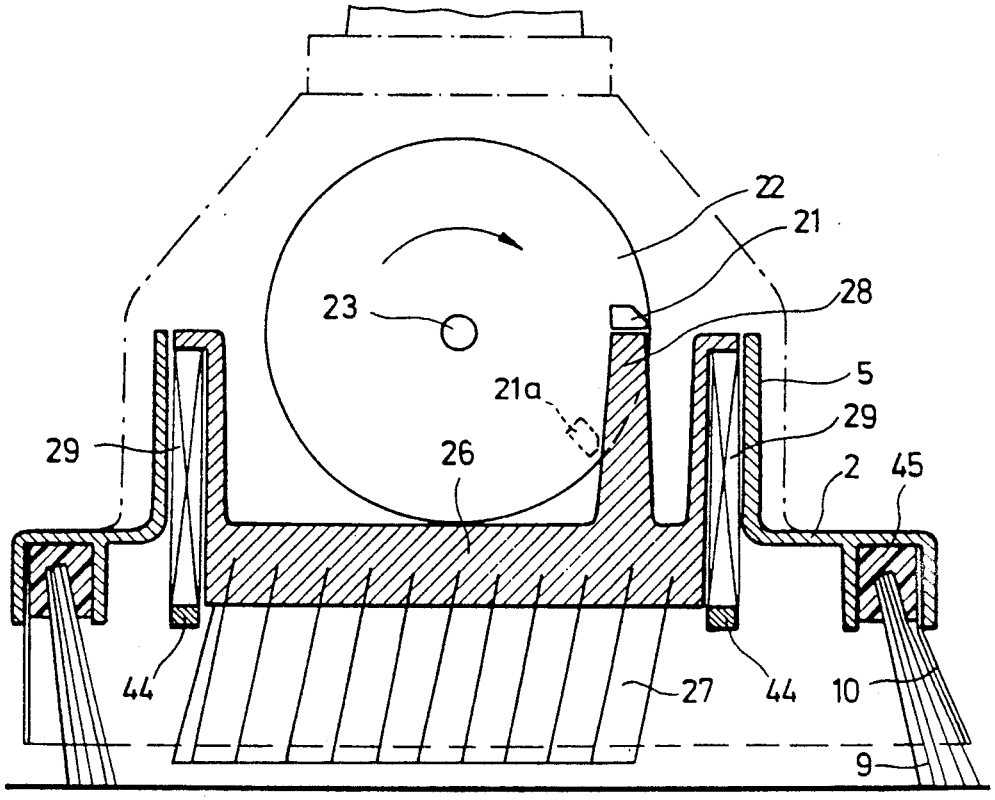
Figure 9A:
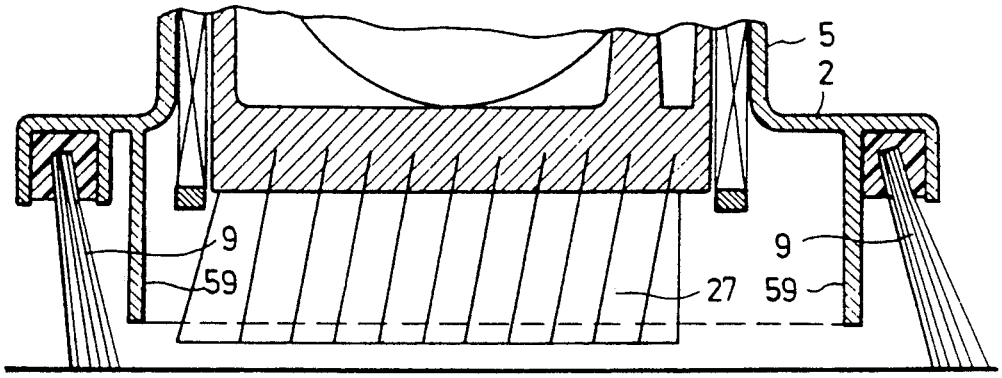
Figure 10:
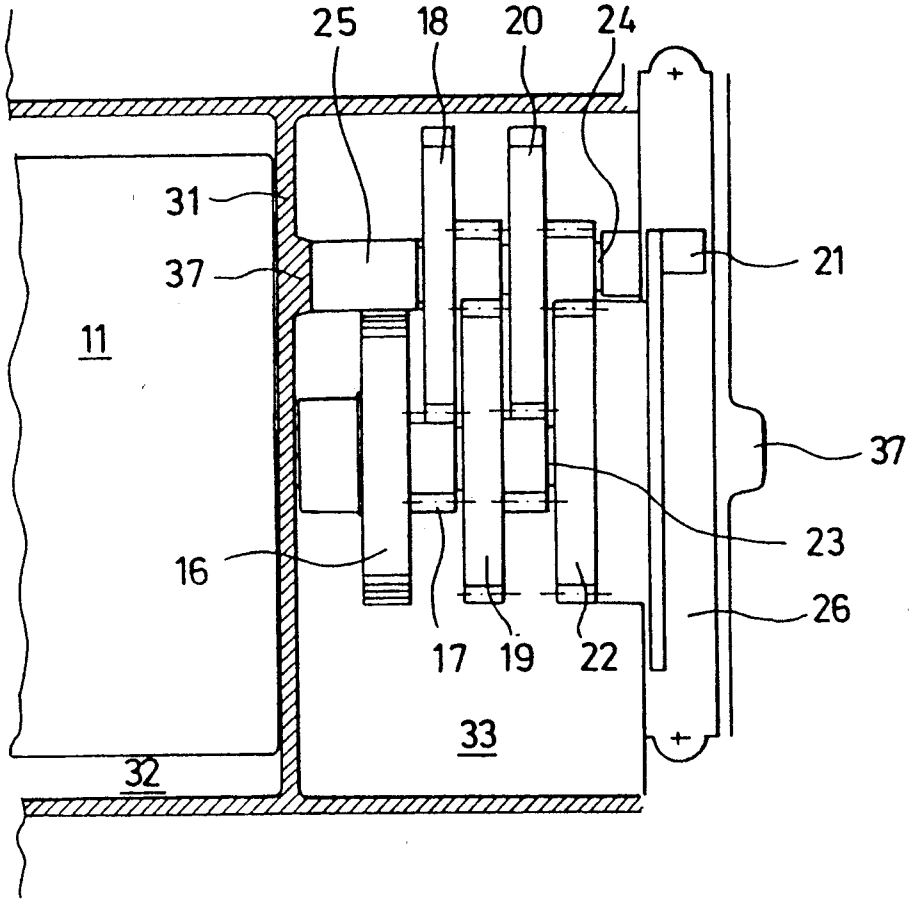

FIG. 8*a* shows a cross-sectional viw of the one-way clutch along line VIIIa—VIIIa of FIG. 8;

FIG. 9 shows a section through FIG. 5 along the line IX—IX of FIG. 5;

FIG. 9*a* shows a partial view of the lower portion of a modified embodiment of the suction head;

FIG. 10 shows a detail of the foot driving meachanism from top with a speed reduction gear train.

According to FIGS. 1 through 5*a,* the suction head housing 2, which has a dome-like prominence 3 enclosing a chamber at its upper side, to whose top a connecting sleeve 4 is rotatably mounted where a suction hose (not shown) is to be attached to operate the suction head 1. The dome-like prominence 3 comprises two parts, a lower part 5 integrally connected to the housing 2 and an upper part 6 detachably mounted thereto, both parts being joined together along a separating line 7. A collar of bristles 9 is exchangeably attached to the lower edge 8 of the housing 2. The free ends of the bristles 9 are in a common plane. The collar of bristles 9 is surrounded by a skirt 10 at the outside, which is also attached to the lower edge 8 of the housing 2 and is to suppress the flow of water through the gaps between the bristles 9. Alternatively, as shown in FIG. 9*a,* a skirt 59 may be disposed inside of the collar of bristles 9 and may be integrally formed with the housing 2 or as a separate element attached thereto.

The bristles 9 are inclined at a small angle of about 8 to 18 degrees against the vertical onto the plane defined by the free ends of the bristles 9.

Figure 3:
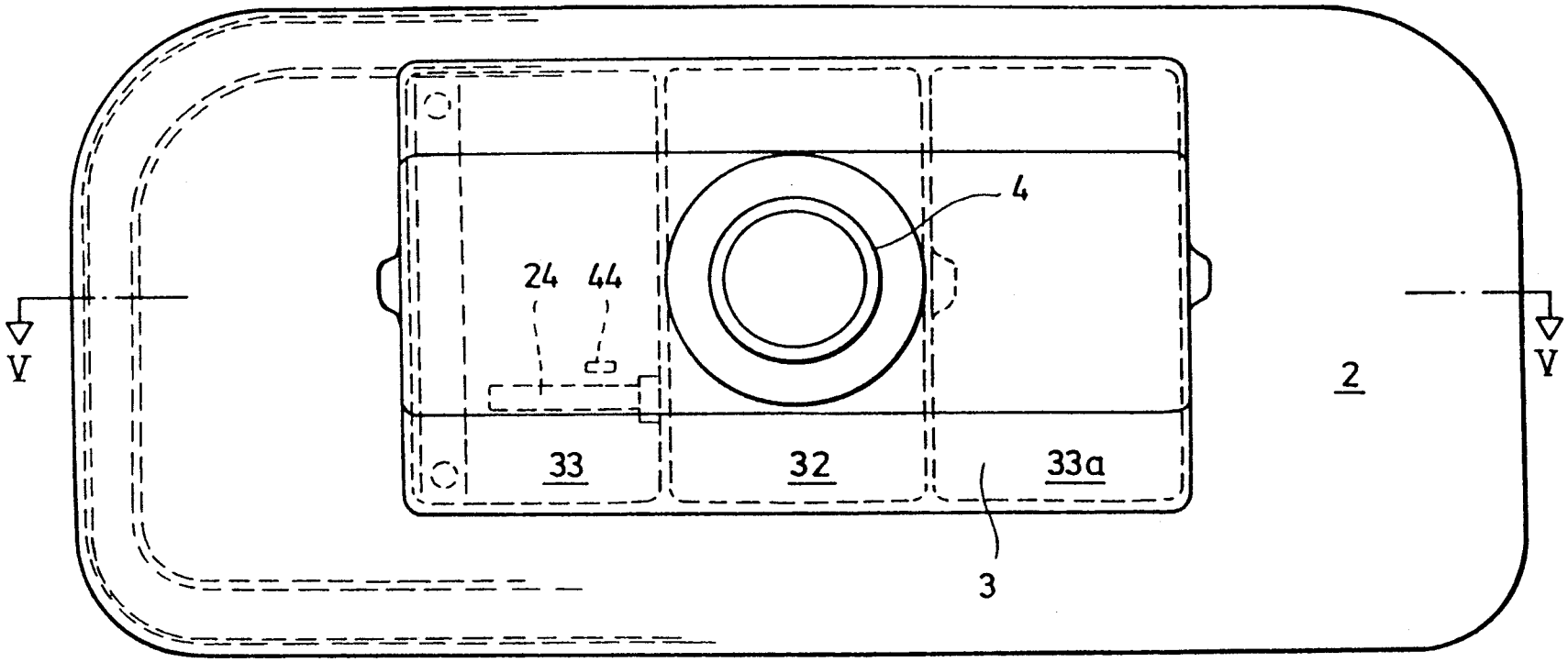
FIG. 3 shows a top view of a suction head essentially corresponding to that of FIG. 1 but having a more rectangular shape when seen from above.
Figure 4:
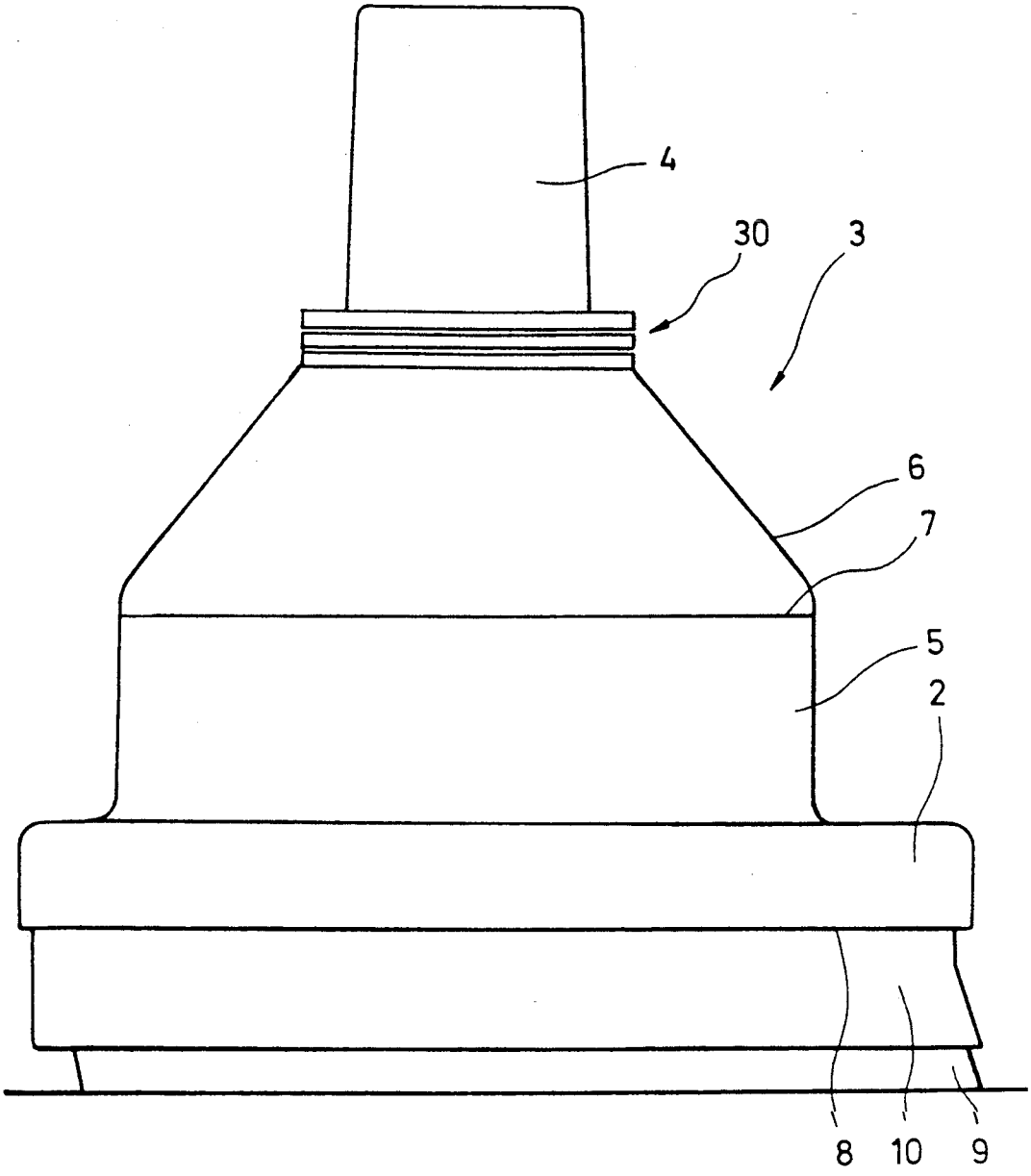
FIG. 4 shows a lateral view of the suction head of FIG. 3 from the left.

When viewed from the top, the housing 2 is of substantially rectangular design, but has in the represented example a slightly curved shape, the front side being convex and the rear side being concave, as seen in FIG. 1, or may be more rectangular, comprising rounded corners, the front side corners being greater than those on the rear side, as seen in FIG. 3.

According to FIG. 5, a vibratory element 11 of crescent-like or airfoil-like cross-section is located in a chamber 32 enclosed by the dome-like prominence 3 and open at its lower side (cf. FIGS. 1 and 6). Said vibratory element 11 has a pivot axis 12 and its convex side points towards the connecting sleeve 4.

As a means of sealing the vibratory element 11 to the adjacent side walls of chamber 32 from bypassing water and yet allowing sand or other small particles to escape so as not to score the walls of chamber 32 or the edges of vibratory element 11, soft bristles 58 of plastic or other suitable material are affixed to the side edges of the vibratory element 11. Those bristles 58 are mounted into frames 56 which are pressed into mating slots 57 in the vibratory element 11.

The vibratory element 11 has a projection 13 of out-of-round cross-section at one side in the swivelling axis 12, which is octagonal in the represented example. Said projection extends through an opening 35 in a side wall 31 of chamber 32 into an adjacent gear chamber 33 formed in the dome-like prominence 3 of housing 2. A commercially available one-way clutch, 14, which has an inner race 15 with an inner opening of octagonal profile is fitted onto the projection 13 in the gear chamber 33.

FIGS. 8 and 8*a* illustrate the various components of said one-way clutch 14 of which there are numerous ones available in the market. It comprises rollers 42 riding between an inner race 15 and a ramp 54 in an wedge body 51 disposed in an outer cylindrical casing 53. Leaf springs 52 hold the rollers 42 in a wedging manner so that when the inner race 15 is turning in one direction the outer casing 53 is driven thereby in the same direction, whereas when the driving direction reverses, the rollers 42 free themselves and the outer and inner components of the clutch may move independent of each other.

To the outer casing 53, a wheel 16 is affixed, said wheel 16 having a gearwheel 17 of smaller diameter integrally connected thereto. Wheel 16 may be designed as a ratchet, as shown in FIG. 7 into which a flexible detent pawl 41 firmly attached to the upper part 6 of the dome-like prominence 3 engages, preventing wheel 16 to rotate in counter-clockwise direction as seen in FIG. 7.

Three further gearwheels 18, 19 and 20 forming a stepdown gear train with the gearwheel 17, and a gearwheel 22 having a projecting tab 21 are also located in gear chamber 33. The vibratory element 11 along with one-way clutch 14 and gearwheel 17 and the gearwheels 19 and 22 are mounted on a common first axle shaft 23, while the gearwheels 18 and 20 are supported by a second axle shaft extending parallely to the first axle shaft 23.

It is evident that the gearwheels 18, 19 and 20 have in each case two gear faces of two different diameters which are in mutual engagement and for engagement with the gearwheels 17 and 22, respectively, to form in this manner a 4-step reduction gear train with a high stepdown ratio. A spacer 25 can furthermore be recognized, which is disposed on the second axle shaft 24.

A brush support 26 is also disposed in gear chamber 33 and is movable in vertical direction and supports at its lower end a brush with inclined bristles 27. The inclination of these bristles 27 is opposite to the inclination of the bristles 9 affixed to the housing. The brush support 26 has a lug 28 at its upper portion, said lug 28 being located in a partial section of the movement path of the projecting tab 21 of gearwheel 22 so that it can be pressed downwardly by said tab 21 against the biasing force of compression return springs 29 supported in the housing 2. Said return springs 29 bias the brush support in a rest position in which the free ends of its bristles 27 are situated in a plane which is upwardly offset from that defined by the bristles 9 attached to the housing 2 so that the bristles 27 are out of contact with the surface to be cleaned.

As can be readily seen in FIG. 5, the rotary connecting sleeve 4 is mounted rotatably on the dome-like prominence 3 by means of a sealed rotary coupling 30.

It can furthermore bee seen in FIG. 5 that chamber 32 formed in the dome-like prominence 3 is downwardly open and houses the vibratory element 11, the connecting sleeve 4 opening in said chamber 32, whereas gear chamber 33 separated from aforementioned chamber 32 by separating wall 31 is closed at its bottom by a bottom wall 34. Gear chamber 33 houses the one-way clutch 14 and all gearwheels which are components of a brush support driving mechanism, and it has an opening in bottom wall 34 to allow for the passage of the brush support 26 with attached bristles 27. The closing of gear chamber 33 effected by the bottom wall 34 prevents dirt from entering into the gear chamber 33 from below.

FIG. 5 also shows that the separating line 7 between the upper part 6 and the lower part 5 of the dome-like prominence 3 lies in the same plane in which the axis of the axle shaft 23 lies. The axle shaft 24 for the gearwheels 18 and 20, which cannot be seen in FIG. 5, also lies in the same plane, see FIG. 7. At the plane of the separating line 7 between the lower part 5 and the upper part 6 of the dome-like prominence 3 corresponding bearing journals 36 and 37 are integrally formed with the lower part 5 and the upper part 6, respectively, to support the ends of the axle shafts 23 and 24.

According to FIG. 6, the separating line 7 extends in a single plane. The lower part 5 has flexible clips 38 elongated upwardly beyond the separating line 7, which end in locking hooks 39 engaging into openings 40 formed in the upper part 6, said hooks retaining the upper part 6 in detachable fashion on the lower part 5. The clips 38 can be inwardly bent back by pressing the locking hooks 39 from the outside, whereby it becomes possible to detach the upper part 6 from the lower part 5. The vibratory element 11 and all components of the brush support driving mechanism and the brush support 26 become freely accessible from above in disengaged condition of the lower and upper parts 5 and 6 and can be dismounted without the aid of any further tools for cleaning and repair, if necessary.

It is evident that the assembly of these elements is correspondingly simplified by this structure. For assembly the vibratory element 11 and the one-way clutch 14 must only be plugged together and the pre-assembled unit formed in this fashion is subsequently slipped onto axle shaft 23, then (ratchet) wheel 16 and the gearwheels 19 and 22 are slipped onto the same axle shaft 23. The gearwheels 18 and 20 and the spacer sleeve 25 are slipped onto the other axle shaft 24. After the brush support 26 together with its return springs 29 have been inserted into the gear chamber 33, the aforementioned pre-assembled subassemblies are placed into the lower part 5 by inserting the ends of the axle shafts 23 and 24 into the associated bearing shells 36. The upper part 6 of the dome-like prominence 3 is subsequently placed onto the lower part 5, whereby the bearing shells 37 formed at the upper part 6 engage the axle shaft ends, and the upper part 6 is locked to the lower part 5 by means of the locking hooks 39 locking in the openings 40.

FIG. 6 also shows that the vibratory element 11 can be pivoted between two end positions which are drawn in dash-dotted fashion with **11*a* and 11*b*. According to FIG. 6, a flow path results in the one end position 11*a*, which passes the right hand side of the vibratory element 11 from the bottom to the top in FIG. 6, while in the other end position 11*b* a flow path results which passes the left hand side of the vibratory element 11. Due to the effect of the flow of water sucked through the suction head, the vibratory element 11 automatically vibrates to and fro between the two end positions 11*a* and 11*b*. It does not have a stable position of equilibrium due to the physical phenomena of its crescent-like shaping, whose concave surface points dowenwardly against the direction of the water flow sucked through the chamber 32. As the effective cross-sectional area of the flow path is not substantially varied by the pivotal movement of the vibratory element 11**, no noticeable pulsations are generated in the water flow passing through the suction head.

The to and fro movement of the vibratory element 11 is transferred into a unidirectional rotational movement by the one-way clutch 14 mounted to the vibratory element 11. Thus, gearwheel 22 is finally driven in one direction only.

As is shown in the sectional representation in FIG. 9, the brush support 26 is guided vertically within the lower part 5 of the dome-like prominence 3. The helical compression return springs 29, which are each supported at the bottom on a lug 44 formed at the housing 2, bias the brush support upwardly. The gearwheel 22 of the brush support driving mechanism is located adjacent to the brush support 26, and the projecting tab 21 is formed on the side of the gearwheel facing said brush support 26. The latter is formed with a lug 28 which is situated in a partial section of the movement path of the tab 21 defined by rotation of the gearwheel 22. Thus, upon clockwise rotation of the gearwheel as seen in FIG. 9, the projecting tab 21 is aligned with the lug 28 and thereby presses the brush support 26 downwardly from the rest position represented in FIG. 9 so that the free ends of the bristles 27 attached to it are downwardly advanced beyond the plane defined by the free ends of the bristles 9 attached to the housing 2. In the position of the projecting tab 21 shown in dashed lines by **21*a* in FIG. 9 the tab 21 disengages from the lug 28 so that the brush support 26 is returned to its rest position by the action of the return springs 29. It can be seen that the lug 28** is in engagement with the projecting tab 21 across about 45° only of the movement path of said tab 21 so that, based on a full rotation of the gear-wheel 22, the brush support 26 is downwardly advanced during ⅛ only of the entire time of rotation of the gearwheel 22. The time during which the bristles 27 are downwardly advanced beyond the plane defined by the free ends of the bristles 9 is consequently only about ⅛ or somewhat less of the operating time of the suction head. The movement path of the suction head is substantially determined by the action caused by the bristles 9 attached to the housing, while a change in the direction of movement is caused in the aforementioned manner by the downward advance of the brush support 26 during relatively short intermediate periods.

As may be seen from FIG. 1*a*, the suction head may be provided with another, second brush support 50 of similar design as the first brush support 26 explained above and having bristles 27 at its lower end. Said second brush support 50 is positioned symmetrically to the first brush support 26 with respect to the center of the suction head 1 defined by the connecting sleeve 4. An actuation wheel 49 similar to gearwheel 22 but not toothed and being likewise provided with a projecting tab 21 is associated to the second brush support 50. In this embodiment of the invention, the first axle shaft 23 is extended to the side opposite to gear chamber 33 and traverses another chamber 33*a* formed in the dome-like prominence 3 symmetrically with respect to gear chamber 33, said other chamber 33*a* housing the actuation wheel 49, the second brush support 50 and associated return springs 29. The gearwheel 22 driving the first brush support 26 by means of tab 21 and lug 28 is fixed to the axle shaft 23 for co-rotation therewith at one of its end portions, whereas the actuation wheel 49 associated to the second brush support 50 is fixed to the axle shaft 23 for co-rotation therewith at the other end portion thereof. Co-rotation of axle shaft 23 and wheels 22 and 49 may be established by out-of-round cross sections of the axle shaft end portions mounting said wheels 22 and 49 and of the respective mating central openings in wheels 22 and 49, so that simplified assembly of the components by slipping the wheels onto the axle shaft 23 is still possible. Other means to fix the axle shaft 23 to wheels 22 and 49 may be choosen as well, e.g. press pins and the like. Thus, rotational movement of gearwheel 22 is transmitted via axle shaft 23 to actuation wheel 49.

As is shown in FIG. 1*a*, the tabs 21 at gearwheel 22 and actuation wheel 49 are offset with respect to each other by 180°. Thus, upon rotation of gearwheel 22, the brush supports 26 and 50 are alternately advanced downwardly. The suction head 1 is therefore partially lifted at one side and, after return of the respctive brush support in its rest postion, subsequently at the other side and so on.

It is further possible to give the suction head a round shape or any other shape of monoplane configuration as the motion producing phenomenon is not affected by the bristle outline configuration.

The components of the suction head, in particular the housing parts, the vibratory element and the wheels of the foot driving mechanism, the connecting sleeve and the brush support consist preferably of plastic material, whereas the axle shafts and rollers consist of stainless steel.

During operation the suction head 1 is connected at its rotary connecting sleeve 4 to a suction hose which in turn is connected to the suction side of a water pump and it is placed into the swimming pool to be cleaned. Under the action of the flow of water created by the water pump and flowing through the chamber 32, the vibratory element 11 performs a vibrating motion. The result of this is that the force with which the suction head 1 rests on the surface to be cleaned is pulsating. And therefore, the bristles 9 are bent and straightened repetitively in the frequency of the pulsation. Thereby, the bristles cause the advance effect mentioned in the opening portion of this specification. The one-way clutch 14 transfers the to and fro going pivotal movement of the vibratory element 11 in a unidirectional rotation by which the gearwheel 22 is driven via gearwheels 17, 18, 19 and 20 to bring the tab(s) 21 in contact with the lug(s) 28 of the brush support(s) 26 (and 50) to advance it (them) gradually downwardly against the bias force of the return springs 29. Due to this, the suction head 1 is lifted at one side as is shown in FIG. 5 by line A. The bristles 9 represented on the lefthand side of FIG. 5, which are still in contact with the surface to be cleaned continue to produce their advance movement, while the bristles 9 represented at the righthand side lose their effect since they are no longer in contact with the surface to be cleaned. However, in lieu of this, the bristles 27 attached to the brush support 26 (or 50) produce an advance movement in the opposite direction which entails in cooperation with the still active bristles 9 that the suction head 1 rotates about an axis vertical to the surface to be cleaned.

It is obvious that the same result, although with reduced effect, can be attained if the brush support 26 does not have bristles 27 but acts as a foot with a preferably high friction coefficient and can be brought into contact with the surface to be cleaned and brakes the movement of the suction head 1 at one side.

By changing the gear train ratios the length of the periods of straight motion and the rotary motion may be varied with respect to each other. Various other modifications may be carried out in the described suction head without leaving the spirit of the present invention.

We claim:

1. A suction head for a swimming pool cleaner comprising a housing which is open at its lower side and is limited there by a lower edge and has a rotary connecting sleeve for connecting a suction hose rotatably mounted to its top, said connecting sleeve opening into a chamber formed in the housing, said chamber being open at its lower end, a vibratory element pivotally mounted in a horizontal axis in said chamber and adapted to automatically pivot to and fro in a vibrating movement if a water flow through said chamber from the lower end to said connecting sleeve is established by means of an external suction pump connected via said suction hose to said connecting sleeve, said vibrating movement of the vibratory element causing a sympathetic vibration of the suction head, and flexible bristles attached to the lower edge of said housing and projecting downwardly from said housing, the free ends of said bristles being adapted to support said suction head on a surface to be cleaned and being arranged in a common plane, and said bristles being inclined in a specific common direction so that they enclose an angle deviating from the vertical onto said plane defined by the free ends of said bristles.

2. A suction head as set forth in claim 1 comprising furthermore at least one movable foot having a lower end and being disposed in the housing offset from a center of the suction head and being displaceable vertically with respect to the plane defined by the free ends of the bristles, and a foot driving mechanism in the housing which is driven by the pivotal movement of the vibratory element via means for transferring said pivotal to-and-fro movement of the vibratory element into a unidirectional rotational movement, said foot driving mechanism comprising means for periodically acting on said at least one foot so as to advance it from a raised rest position in which the lower end of said foot is retracted with respect to the plane defined by the free ends of said bristles to a lowered active position in which the lower end of said foot projects beyond said plane so as to lift said suction head one-sidedly from the surface to be cleaned, and further comprising return means for returning said foot into its raised rest position.

3. A suction head as set forth in claim 2 wherein said means for transferring the pivotal to and fro movement of said vibratory element is a one-way clutch mounted to a projection of the vibratory element in the pivot axis thereof.

4. A suction head as set forth in claim 3 wherein said projection has an out-of-round cross-section and said one-way clutch has a complementary center opening mating therewith, said one-way clutch being plugged onto said projection.

5. A suction head as set forth in claim 2 wherein said foot driving mechanism also comprises a gearwheel provided with a projecting tab and rotatably mounted in the housing, said tab describing a circular movement path upon rotation of the gearwheel, the foot having a lug which is located in a partial section of said circular movement path so that said lug together with the foot is pushed by said tab downwardly in the direction of said plane defined by the free ends of the bristles upon rotation of said gearwheel, said return means comprising at least one return spring in the housing biasing the foot into the rest position when said tab disengages from said lug upon continued rotation of said gearwheel.

6. A suction head as set forth in claim 5 comprising a second movable foot having a lower end and being disposed in said housing symmetrically to said first-mentioned foot with respect to a center of said suction head defined by said connecting sleeve, said second foot being mounted in said housing to be vertically displaceable from a raised rest position in which the lower end of said second foot is raised with respect to the plane defined by the free ends of the bristles into a lowered active position in which the lower end of said second foot projects downwardly beyond said plane, and second driving means coupled to said first foot driving means and comprising means for periodically acting on said second foot so as to advance it from its raised position into the lowered position, and second return means for returning said second foot into its raised rest position.

7. A suction head as set forth in claim 6 wherein said means for periodically acting on said second foot comprise a wheel fixed for co-rotation with the gearwheel driving the first-mentioned foot on a common axis shaft, said wheel having a tab for pushing a lug formed on said second foot.

8. A suction head as set forth in claim 7 wherein the tabs pushing the lugs of said first and second feed are offset from each other by an angle of 180° so that said feet are alternately displaced by said driving means.

9. A suction head as set forth in any one of claims 6 to 8 wherein the second foot is formed by a brush support having a bottom end to which bristles are attached, said bristles having an inclination opposite to the inclination of the bristles attached to the housing, the free ends of said bristles attached to the brush support being the lower end of said second foot.

10. A suction head as set forth in claim 5 wherein at least one component of the group of components comprising the housing, the vibratory element, the gearwheels and the connecting sleeve consists of plastic material.

11. A suction head as set forth in claim 2 wherein the foot is formed by a brush support having a bottom end to which flexible bristles are attached, the bristles being inclined in a direction opposite to the inclination of the bristles attached to the housing, the free ends of the bristles attached to the brush support forming the lower end of the foot.

12. A suction head as set forth in claim 2 wherein a stepdown gear train having several pairs of meshing gearwheels is interposed between said means for transferring said pivotal to-and-fro movement of said vibratory element into a unidirectional movement and said means for periodically acting on said at least one foot.

13. A suction head as set forth in claim 12, wherein the vibratory element and said gearwheels are disposed on two axle shafts and the housing consists of at least two parts which are connected to each other along a separating line, which extends through the axes of said axle shafts.

14. A suction head as set forth in claim 13 wherein the two housing parts are detachably connected with each other.

15. A suction head as set forth in claim 2 wherein the at least one foot is removably supported in the housing.

16. A suction head as set forth in claim 1 wherein the bristles are exchangeably attached to the lower edge of the housing.

17. A suction head as set forth in claim 1 wherein the rotary connecting sleeve is rotatably mounted to the top of the housing.

18. A suction head as set forth in claim 17 wherein the rotary connecting sleeve is mounted on the housing by means of a rotary seal.

19. A suction head as set forth in claim 1 wherein the vibratory element comprises bristles at the edges adjacent the walls of said chamber.

20. A suction head as set forth in claim 1 wherein the housing has a substantially rectangular shape when seen from above, the connecting sleeve being disposed approximately in the center of the top of the housing and the angle of inclination of the bristles extending in a plane being in parallel to the narrow sides of the housing.

21. A suction head as set forth in claim 2 or 20 wherein the movable foot is disposed in the housing between the center of the housing and one of the narrow sides.

22. A suction head as set forth in claim 6 or 20 wherein a movable foot is disposed in the housing to either side of the center of the housing between said center and the narrow sides of the housing, respectively.

23. In a swimming pool cleaner suction head of the type having a housing forming a chamber open at its lower side and a connection for a hose by which a remote suction pump establishes a water flow through the chamber and into the hose, the improvement comprising:

a vibrator device secured to the housing to vibrate the suction head in response to flow of water through the chamber; and flexible main bristles secured with respect to the housing and projecting downwardly therefrom to terminate in free main-bristle ends adapted to support the suction head on a surface to be cleaned, a preponderance of the main bristles being inclined such that when the main-bristle ends engage a horizontal surface to be cleaned, such preponderance of main bristles deviate from vertical in a common direction, whereby such main bristles and vibrator device work together to cause forward movement of the suction head over the surface to be cleaned.

24. The swimming pool cleaner suction head of claim 23 wherein the vibrator device comprises a vibratory element pivotably mounted with respect to said housing and adapted to automatically pivot to and fro.

25. The swimming pool cleaner suction head of claim 23 wherein the housing has a lower edge surrounding the chamber and the main bristles are secured to the housing along the lower edge.

26. The swimming pool cleaner suction head of claim 23 further including means below the housing to turn the direction of suction head movement during forward movement thereof.

27. The swimming pool cleaner suction head of claim 26 wherein the main-bristle ends are disposed substantially in a common plane and wherein the turning means comprises:

a vertically-displaceable foot disposed in the housing in an off-center position, the foot having a lower end normally positioned above the common plane; and means associated with the foot to periodically displace the foot vertically such that its lower end moves below the common plane;

whereby one end of the suction head is temporarily lifted such that continuing movement of the suction head causes the suction head to change direction.

28. The swimming pool cleaner suction head of claim 27 wherein the foot lower end is formed by foot bristles having foot-bristle ends, the foot bristles being inclined such that when the foot-bristle ends engage a horizontal surface to be cleaned the foot bristles deviate from vertical in a direction opposite to the common direction of the main bristles, thereby to facilitate turning of the suction head.

29. The swimming pool cleaner suction head of claim 27 comprising a pair of said feed and displacement means, the displacement means arranged to displace the feet at different times.

30. The swimming pool cleaner suction head of claim 29 wherein the feet are on opposite sides of center.

31. The swimming pool cleaner suction head of claim 27 wherein the vibrator device comprises a vibratory element pivotably mounted with respect to said housing and adapted to automatically pivot to and fro.

32. The swimming pool cleaner suction head of claim 31 wherein the displacing means comprises mechanical linkage means for transferring the pivoting to-and-fro movement of the vibratory element into periodical vertical displacement of the foot, such that both forward and turning motions of the suction head are provided by water flow through the chamber.

33. In a swimming pool cleaner suction head of the type having a housing forming a chamber open at its lower side and a connection for a hose by which a remote suction pump establishes a water flow through the chamber and into the hose, the improvement comprising:

a vibrator device secured to the housing to vibrate the suction head in response to flow of water through the chamber; and resilient supports secured with respect to the housing and projecting downwardly therefrom to terminate in support ends adapted to support the suction head on a surface to be cleaned, the resilient supports inclined such that, when the support ends engage a horizontal surface to be cleaned, the resilient supports deviate from vertical in a common direction to produce, upon vibration of the housing, greater resistance to movement in one lateral direction than in the opposite lateral direction;

thereby to provide a forward driving movement of the suction head.

34. The swimming pool cleaner suction head of claim 33 wherein the resilient supports are bristles.

35. The swimming pool cleaner suction head of claim 33 further including means below the housing to change the direction of suction head movement during forward movement thereof.

36. The swimming pool cleaner suction head of claim 35 wherein the support ends are disposed substantially in a common plane and wherein the turning means comprises:

a vertically-displaceable foot disposed in the housing in an off-center position, the foot having a lower end normally positioned above the common plane; and means associated with the foot to periodically displace the foot vertically such that its lower end moves below the common plane;

whereby one end of the suction head is temporarily lifted such that continuing movement of the suction head causes the suction head to change direction.

37. The swimming pool cleaner suction head of claim 36 wherein:

the vibrator device comprises a vibratory element pivotably mounted with respect to said housing and adapted to automatically pivot to and fro;

the displacing means comprises mechanical linkage means for transferring the pivoting to-and-fro movement of the vibratory element into periodical vertical displacement of the foot, such that both forward and turning motions of the suction head are provided by water flow through the chamber.

* * * * *

UNITED STATES PATENT AND TRADEMARK OFFICE

CERTIFICATE OF CORRECTION

PATENT NO. : 5,293,659

DATED : March 15, 1994

INVENTOR(S) : Dieter J. Rief, Herman E. Frentzel, Jerauld G. Wright and Paul Sebor It is certified that error appears in the above-indentified patent and that said Letters Patent is hereby corrected as shown below:

In column 1, line 6, change "not" to --now--.

In column 1, line 7, change "991" to --1991--.

In column 1, line 18, change "4 275 474" to --4,275,474--.

In column 1, line 32, change "4 351 077" to --4,351,077--

In column 3, line 56, after "head" insert --1 comprises a--.

In column 4, line 38, change "clutch, 14" to --clutch 14--.

UNITED STATES PATENT AND TRADEMARK OFFICE

CERTIFICATE OF CORRECTION

PATENT NO. : 5,293,659

DATED : March 15, 1994

INVENTOR(S) : Dieter J. Rief, Herman E. Frentzel, Jerauld G. Wright and Paul Sebor It is certified that error appears in the above-indentified patent and that said Letters Patent is hereby corrected as shown below:

Column 9:

In claim 7, line 4, change "axis" to --axle--.

Signed and Sealed this

Twenty-fourth Day of January, 1995

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,293,659 Page 1 of 2

DATED : March 15, 1994

INVENTOR(S) : Dieter J. Rief, Herman E. Frentzel, Jerauld G. Wright and Paul Sebor It is certified that error appears in the above-indentified patent and that said Letters Patent is hereby corrected as shown below:

In column 1, line 6, change "not" to --now--.

In column 1, line 7, change "991" to --1991--.

In column 1, line 18, change "4 275 474" to --4,275,474--.

In column 1, line 32, change "4 351 077" to --4,351,077--.

In column 1, line 55, after "rapidly" insert --be--.

In column 2, line 50, change "straighly," to --straightly,--.

In column 2, line 58, change "thre" to --the--.

In column 3, lines 54 and 55, change "meach-anism" to --mechanism--.

In column 3, line 56, after "head" insert --1 comprises a--.

In column 4, line 38, change "clutch, 14" to --clutch 14--.

In column 4, line 45, change "in an" to --in a--.

UNITED STATES PATENT AND TRADEMARK OFFICE

CERTIFICATE OF CORRECTION

PATENT NO. : 5,293,659 Page 2 of 2

DATED : March 15, 1994

INVENTOR(S) : Dieter J. Rief, Herman E. Frentzel, Jerauld G. Wright and Paul Sebor It is certified that error appears in the above-indentified patent and that said Letters Patent is hereby corrected as shown below:

In column 5, line 29, change "bee" to --be--.

In column 6, line 33, change "dowenwardly" to --downwardly--.

Column 9,

In claim 3, line 2, change "to and fro" to --to-and-fro--.

In claim 7, line 4, change "axis" to --axle--.

In claim 8, line 2, change "feed" to --feet--.

This certificate supersedes Certificate of Correction issued January 24, 1995.

Signed and Sealed this

Eighth Day of August, 1995

*Attest:*

Bruce Lehman

BRUCE LEHMAN

*Attesting Officer*

*Commissioner of Patents and Trademarks*